US009366063B2

(12) United States Patent
Rosales et al.

(10) Patent No.: US 9,366,063 B2
(45) Date of Patent: Jun. 14, 2016

(54) MOTOR VEHICLE LOCK

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 6 days.

(21) Appl. No.: 13/929,278

(22) Filed: Jun. 27, 2013

(65) Prior Publication Data

US 2014/0284944 A1 Sep. 25, 2014

Related U.S. Application Data

(60) Provisional application No. 61/804,928, filed on Mar. 25, 2013.

(51) Int. Cl.

| | |
|---|---|
| ***E05C 3/16*** | (2006.01) |
| ***E05B 85/26*** | (2014.01) |
| ***E05B 77/06*** | (2014.01) |

(52) U.S. Cl.

CPC ..... *E05B 85/26* (2013.01); *E05B 77/06* (2013.01); *Y10T 292/0917* (2015.04)

(58) Field of Classification Search

CPC ..... E05B 77/02; E05B 77/04; E05B 77/06
USPC ..... 292/201, 216, DIG. 22, DIG. 23, 92, 292/DIG. 65

See application file for complete search history.

(56) References Cited

U.S. PATENT DOCUMENTS

| | | | |
|---|---|---|---|
| 4,441,345 | A | 4/1984 | Guarr |
| 5,967,572 | A | 10/1999 | Sajfert et al. |

(Continued)

FOREIGN PATENT DOCUMENTS

| | | |
|---|---|---|
| DE | 10337392 | 3/2005 |
| DE | 202009009060 | 1/2011 |

(Continued)

OTHER PUBLICATIONS

Computer-Generated Translation, proquest.com, Translated on Mar. 23, 2015.*

(Continued)

*Primary Examiner* — Alyson M Merlino
(74) *Attorney, Agent, or Firm* — Pauly, Devries Smith & Deffner, LLC

(57) ABSTRACT

The invention is directed to a lock for a door arrangement, wherein a catch and a pawl are provided. The catch can be brought into an opening position and into a closed position. The catch may be brought into holding engagement with a lock striker. The pawl may be brought into an engagement position. The pawl may be deflected into a release position. A pawl actuation lever is provided for deflecting the pawl. An engagement arrangement is provided. The engagement arrangement comprises a deflection lever on the side of the pawl actuation lever and a counter contour on the side of the pawl. The deflection lever is configured to engage the counter contour. An actuation movement of the pawl actuation lever can deflect the pawl into the release position. An inertial characteristic of the deflection lever causes a deflection movement along a free-wheeling path.

17 Claims, 4 Drawing Sheets

(56) References Cited

U.S. PATENT DOCUMENTS

| | | | | |
|---|---|---|---|---|
| 7,175,211 | B2 | 2/2007 | Cetnar et al. | |
| 8,727,398 | B2 | 5/2014 | Brose et al. | |
| 8,764,077 | B2 * | 7/2014 | Takagi et al. | 292/336.3 |
| 8,967,678 | B2 | 3/2015 | Rosales et al. | |
| 9,074,393 | B2 | 7/2015 | Brose et al. | |
| 9,109,380 | B2 | 8/2015 | Mittelbach et al. | |
| 2006/0267351 | A1 | 11/2006 | Spurr | |
| 2009/0322105 | A1 * | 12/2009 | Lee et al. | 292/237 |
| 2011/0181052 | A1 | 7/2011 | Brose et al. | |
| 2011/0252844 | A1 | 10/2011 | Shoemaker | |
| 2013/0147209 | A1 * | 6/2013 | Lee et al. | 292/57 |
| 2013/0147211 | A1 * | 6/2013 | Lee et al. | 292/198 |
| 2013/0313036 | A1 | 11/2013 | Kovie | |
| 2013/0328325 | A1 | 12/2013 | Uehara et al. | |
| 2014/0097624 | A1 * | 4/2014 | Papanikolaou et al. | 292/202 |
| 2014/0284942 | A1 | 9/2014 | Wittelsbuerger et al. | |
| 2014/0284943 | A1 | 9/2014 | Wittelsbuerger et al. | |
| 2014/0284945 | A1 | 9/2014 | Wittelsbuerger et al. | |
| 2014/0346786 | A1 * | 11/2014 | Takagi et al. | 292/200 |
| 2015/0115628 | A1 | 4/2015 | Wittelsbuerger et al. | |

FOREIGN PATENT DOCUMENTS

| | | | |
|---|---|---|---|
| DE | 202009009061 | | 1/2011 |
| WO | WO 2011010554 | A1 * | 1/2011 |
| WO | WO 2011110142 | A1 * | 9/2011 |
| WO | WO 2012014069 | A1 * | 9/2012 |
| WO | WO 2013046317 | A1 * | 4/2013 |

OTHER PUBLICATIONS

Non-Final Office Action for U.S. Appl. No. 13/929,258, mailed Mar. 27, 2015 (17 pages).

Non-Final Office Action for U.S. Appl. No. 13/929,265 mailed Aug. 10, 2015 (8 pages).

Search Report for German Patent Application No. 102014104188.6 related to U.S. Appl. No. 13/929,258, mailed Dec. 9, 2014 (7 pages).

German Search Report, for DE 10 2014 104 111.9, mailed Dec. 1, 2014 (7 pages).

Amendment and Response filed, Jan. 11, 2016, 8 pages.

Final Office Action for U.S. Appl. No. 13/929,258 mailed Nov. 27, 2015 (14 pages).

* cited by examiner

MOTOR VEHICLE LOCK

CLAIM OF PRIORITY

This application claims the benefit of priority, under 35 U.S.C. Section 119(e), to U.S. Provisional Application No. 61/804,928, filed Mar. 25, 2013, which is hereby incorporated by reference herein in its entirety.

FIELD OF THE INVENTION

The invention is directed to a motor vehicle lock for a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

Crash safety plays an important role for today's motor vehicle locks. It is in particular important that neither crash induced acceleration nor crash induced deformation leads to an accidental and unintended opening of the motor vehicle door which the motor vehicle lock is assigned to. The focus of the present application is to prevent an unintended opening of the motor vehicle door based on crash induced acceleration. In case of an impact, in particular a side impact, the motor vehicle, including the motor vehicle door, is subjected to a very high acceleration. Because the outer door handle comprises an inertial mass which is not rigidly connected to the vehicle door, the outer door handle does not immediately follow the movement of the motor vehicle door which is due to the acceleration stemming from the impact. As a result, a relative movement between the outer door handle and the motor vehicle door is caused, which may correspond to an opening movement of the outer door handle and thereby lead to an unintended opening of the motor vehicle door.

The known motor vehicle lock (US 2011/0181052 A1), which is the starting point for the present invention, is provided with the usual lock elements catch and pawl, wherein the pawl may be deflected into a release position by actuation of a pawl actuation lever.

The known motor vehicle lock also comprises a lock mechanism which may be brought into different functional states such as "unlocked" and "locked" by the user. The pawl may be deflected into its release position by an outer door handle which is connected to the pawl actuation lever if the lock mechanism is in its unlocked state. With the lock mechanism being in its locked state, an actuation of the pawl actuation lever runs free.

To guarantee a high crash safety the known motor vehicle lock comprises a crash element which is a separate component from the pawl actuation lever. By the accelerations which occur during a crash, the crash element moves into a blocking position in which the crash element blocks further actuation of the pawl actuation lever.

One disadvantage of the known motor vehicle lock is the fact that, before the intended blocking of the pawl actuation lever takes place, the crash element has to perform the above noted movement into the blocking position. The necessity of the movement of the crash element before the intended blocking takes place leads to undesirable reaction times of the crash safety function.

Furthermore for the known motor vehicle lock, the constructional design of the drive train between the door handle and the pawl appears to be challenging. This is true as in a crash situation not only the pawl actuation lever, but in fact the whole drive train starting from the door handle to the pawl actuation lever is being locked. In order not to run the risk of an unpredictable breakage of some component in this drive train, i.e. even some component other than the pawl actuation lever, it has to be designed for exceptionally high forces, which in turn leads to high material and production costs.

SUMMARY

It is the object of the invention to improve the known motor vehicle lock such that a cost effective constructional design is possible without reducing the resulting crash safety.

The above noted object is solved for a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein a pawl actuation lever is provided for deflecting the pawl into the release position, wherein an engagement arrangement is provided between the pawl actuation lever and the pawl, wherein the engagement arrangement comprises a deflection lever on the side of the pawl actuation lever and a counter contour on the side of the pawl, wherein the deflection lever is configured to engage the counter contour, thereby deflecting the pawl into the release position, wherein an actuation movement of the pawl actuation lever for deflecting the pawl into the release position is translated into a deflection movement of the deflection lever, wherein an inertial characteristic of the deflection lever causes a deflection movement along a free-wheeling path, in which free-wheeling path the deflection lever misses the counter contour, when the actuation movement surpasses a rapidity threshold, and causes a deflection movement along an engagement path, in which engagement path the deflection lever engages the counter contour, when the actuation movement is below the rapidity threshold.

An important recognition underlying the present invention is that it is better to nudge a moving component into a free-wheeling path in the case of a crash rather than to block a moving component in the case of a crash. This is because, as was already pointed out, in the case of the crash the door handle may experience a very fast relative movement to the vehicle door, thereby causing a very high velocity of the moving component which in turn may cause that moving component or some other part involved to break when it is being blocked. If, on the other hand, the moving component is on a free-wheeling path in case of a crash, there is no impact associated with such a blocking. Conversely, in the absence of a crash, i.e. during normal operation of the door handle, that moving component remains on an engagement path, thereby engaging the respective counterpart.

The invention is further based on the realization that a deflection lever used to deflect the pawl into a release position by engaging it when the door handle is actuated, is just such a component that could be set free-wheeling on a crash to achieve the desired crash safety behavior.

A distinction between the crash situation and a normal operating situation of the door handle may then be made based on the level of acceleration or speed with which the door handle—and as a result, the pawl actuation lever—is moved. Very high velocity or acceleration of the pawl actuation lever is indicative of a crash state. Therefore the inertial properties of the deflection lever, which is then either set on an engaging path or on a free-wheeling path, may be exploited. That is, the inertial properties of the deflection lever may be chosen such that in cases of high acceleration or velocity a free-wheeling movement is performed, whereas in the cases of lower acceleration or velocity a normal, an engaging movement of the deflection lever occurs.

This approach has the further benefit of obviating the need for a separate blocking component. Such a separate blocking component is undesirable because it is only used in the crash state, according to the prior art solution, and therefore serves no purpose in the normal operation state. By using the same component, i.e. the deflection lever, which is also used irrespective of crash safety, either on a free-wheeling or an engagement path, there is no need for a separate component. Thus, all components that are used in a normal operation mode suffice to implement the crash safety mode according to the invention. In other words, a component that was already present and used for the transmission of force from the door handle to the pawl may be arranged and configured such that a different behavior for different levels of velocity or acceleration, in particular different movement paths, result.

Thereby this approach provides an economical solution which omits extraneous components and avoids a risk of breakage caused by absorption of high velocity impacts.

An aspect of particular importance for the invention is that an at least partly resilient guiding arrangement is provided for sliding engagement with the deflection lever, which guides the deflection lever into the engagement path, when the actuation movement is below the rapidity threshold. This arrangement generally allows to utilize the inertial characteristics of the deflection lever such that the deflection lever performs a deflection movement along the free-wheeling path, when the actuation movement surpasses the rapidity threshold.

In a further preferred embodiment the inertial characteristic of the deflection lever is configured such that with increasing rapidity of the actuation movement of the pawl actuation lever the guiding force required to guide the deflection lever into the engagement path increases as well.

A motor vehicle lock, wherein an at least partly resilient guiding arrangement is provided for sliding engagement with the deflection lever and which guides the deflection lever into the engagement path, when the actuation movement is below the rapidity threshold and wherein, when the actuation movement surpasses the rapidity threshold, the inertial characteristic of the deflection lever causes the deflection lever to exert forces onto the resilient guiding arrangement via the sliding engagement, such that the resilient guiding arrangement deforms and releases the deflection lever into the free-wheeling path is directed to a solution that allows a particularly simple mechanical construction. Due to the inertial characteristic of the deflection lever, and in particular due to the guiding forces that increase with rapidity, the resilient guiding arrangement is deformed, when the actuation movement surpasses the rapidity threshold. The deformation of the guiding arrangement in this case is such that the deflection lever may then continue in the free-wheeling path.

An above noted guiding arrangement may easily be realized by utilizing a spring arrangement, in particular a spring arrangement according to a motor vehicle lock, wherein the spring arrangement comprises a leg spring, one of which legs provides at least a part of the guiding contour for sliding engagement with the deflection lever and which deflects to deform the guiding arrangement for release of the deflection lever into the free-wheeling path, when the actuation movement surpasses a rapidity threshold. Here, the spring arrangement comprises a leg spring, which provides the necessary resiliency of the guiding arrangement with low cost.

Further, the preferred embodiment wherein a lock mechanism is provided, which may be brought into different functional states such as "unlocked" and "locked" and wherein the lock mechanism acts on the deflection lever for realizing the functional states "unlocked" and "locked" such that in the functional state "unlocked" the lock mechanism causes a deflection movement along the free-wheeling path and in the functional state "locked" the lock mechanism causes a deflection movement along the engagement path suggests making use of the aforementioned mechanism to implement different functional states of the lock such as "unlocked" and "locked". For example, in such a "locked" state, in order to prevent deflection of the pawl into the release position, some mechanical structure may be used to force the deflection lever into the free-wheeling path, thereby replicating the crash situation. This implementation of different functionalities by reusing components reduces overall system complexity and costs.

In an embodiment the invention provides a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein a pawl actuation lever is provided for deflecting the pawl into the release position, wherein an engagement arrangement is provided between the pawl actuation lever and the pawl, wherein the engagement arrangement comprises a deflection lever on the side of the pawl actuation lever and a counter contour on the side of the pawl, wherein the deflection lever is configured to engage the counter contour, thereby deflecting the pawl into the release position, wherein an actuation movement of the pawl actuation lever for deflecting the pawl into the release position is translated into a deflection movement of the deflection lever, wherein an inertial characteristic of the deflection lever causes a deflection movement along a free-wheeling path, in which free-wheeling path the deflection lever misses the counter contour, when the actuation movement surpasses a rapidity threshold, and causes a deflection movement along an engagement path, in which engagement path the deflection lever engages the counter contour, when the actuation movement is below the rapidity threshold.

In an embodiment, the counter contour is arranged on a contour plate which is coupled torque-proof to the pawl and/or wherein the deflection lever comprises a corner profile for engaging the counter contour.

In an embodiment, a free-wheeling pre-tension force towards the free-wheeling path is exerted on the deflection lever.

In an embodiment, the inertial characteristic of the deflection lever comprises the inertial mass and/or the center of mass, which inertial characteristic is configured such that it causes a deflection movement along the free-wheeling path when the actuation movement surpasses a predetermined rapidity threshold.

In an embodiment, an at least partly resilient guiding arrangement is provided for sliding engagement with the deflection lever and which guides the deflection lever into the engagement path, when the actuation movement is below the rapidity threshold.

In an embodiment, the deflection lever comprises an engagement surface for the sliding engagement with the guiding arrangement.

In an embodiment, when the actuation movement surpasses the rapidity threshold, the inertial characteristic of the deflection lever causes the deflection lever to exert forces onto the resilient guiding arrangement via the sliding engagement, such that the resilient guiding arrangement deforms and releases the deflection lever into the free-wheeling path.

In an embodiment, the resilient guiding arrangement comprises a guiding contour for the sliding engagement with the deflection lever, which guiding contour, during deformation of the guiding arrangement due to surpassing of the rapidity threshold by the actuation movement, is being deformed or displaced.

In an embodiment, the guiding arrangement is an elastically resilient guiding arrangement.

In an embodiment, the guiding arrangement comprises a spring arrangement which compresses for deformation of the guiding arrangement, when the actuation movement of the deflection lever surpasses the rapidity threshold.

In an embodiment, the spring arrangement comprises a leg spring, one of which legs provides at least a part of the guiding contour for sliding engagement with the deflection lever and which deflects to deform the guiding arrangement for release of the deflection lever into the free-wheeling path, when the actuation movement surpasses a rapidity threshold.

In an embodiment, a separation contour is engageable with the deflection lever after deformation of the guiding arrangement due to surpassing of the rapidity threshold by the actuation movement, which engagement prevents the deflection lever to move between the free-wheeling path and the engagement path.

In an embodiment, the deflection lever is configured to pivot around a deflection lever axis.

In an embodiment, the engagement arrangement comprises a return spring arrangement configured to exert a return force on the pawl actuation lever.

In an embodiment, a lock mechanism is provided, which may be brought into different functional states such as "unlocked" and "locked" and wherein the lock mechanism acts on the deflection lever for realizing the functional states "unlocked" and "locked" such that in the functional state "unlocked" the lock mechanism causes a deflection movement along the free-wheeling path and in the functional state "locked" the lock mechanism causes a deflection movement along the engagement path.

In an embodiment, the free-wheeling pre-tension force towards the free-wheeling path is exerted by a free-wheeling spring arrangement.

In an embodiment, the engagement surface is located in an end section of the deflection lever, which end section is also assigned to the engagement with the counter contour.

In an embodiment, the pawl actuation lever is configured to pivot around an actuation lever axis and the deflection lever is pivotably coupled to the pawl actuation lever via the deflection lever axis.

In an embodiment, the deflection lever axis is displaced from the actuation lever axis.

In an embodiment, the return spring arrangement exerts a return force on a return protrusion of the pawl actuation lever, in a direction opposite to, i.e. counteracting, the deflection movement.

In an embodiment, a locking lever of the lock mechanism engages a lock contour of the deflection lever for causing a deflection movement along the free-wheeling path, in particular, wherein the lock contour is arranged at a same end of the deflection lever as the corner profile.

BRIEF DESCRIPTION OF THE FIGURES

In the following, the invention will be described in an example referring to the drawings. In the drawings there is shown in FIG. 1 the proposed motor vehicle lock in the non-actuated state in a frontside view, FIG. 2 the motor vehicle lock according to FIG. 1 in the non-actuated state in a backside view, FIG. 3 selected components of the motor vehicle lock according to FIG. 1 a) in a half actuated state during normal operation and b) in the fully actuated state during normal operation and FIG. 4 the motor vehicle lock according to FIG. 3 during a crash induced actuation.

DETAILED DESCRIPTION

Figure 1:
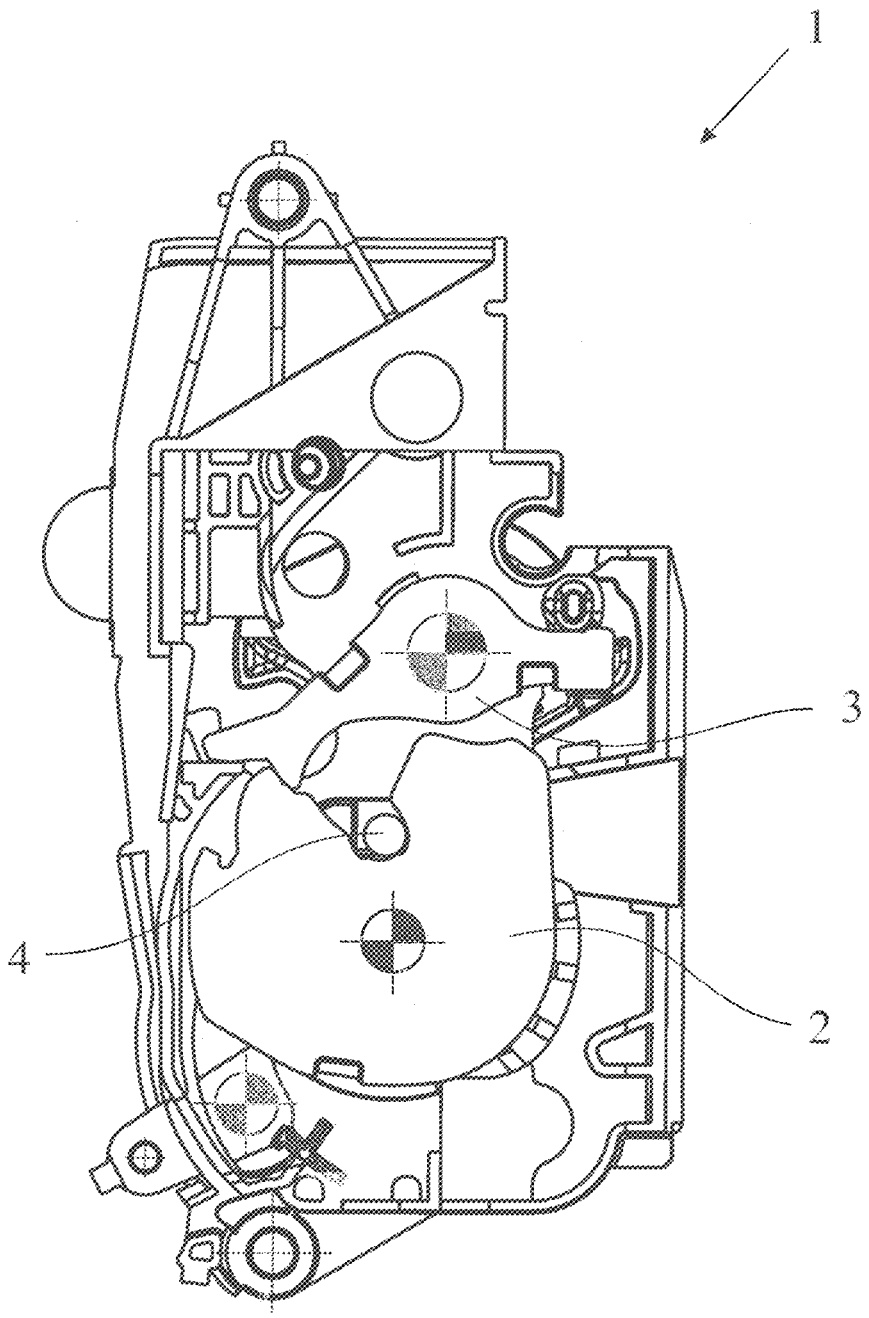

The motor vehicle lock 1 shown in the drawing is assigned to a motor vehicle door arrangement which comprises a motor vehicle door (not shown) beside said motor vehicle lock 1. Regarding the broad interpretation of the expression "motor vehicle door", reference is made to the introductory part of the specification. Here the motor vehicle door is a side door of the motor vehicle, which is also the preferred situation.

The motor vehicle lock 1 comprises the usual locking elements catch 2 and pawl 3, which pawl 3 is assigned to the catch 2. The catch 2 can be brought into an open position (not shown) and into a closed position. In the closed position shown in particular in FIG. 1, the catch 2 is or may be brought into holding engagement with a lock striker 4, which is shown in FIG. 1 as well. The motor vehicle lock 1 is normally arranged at or in the motor vehicle door, but the lock striker 4 is usually arranged at the motor vehicle body.

Figure 3:
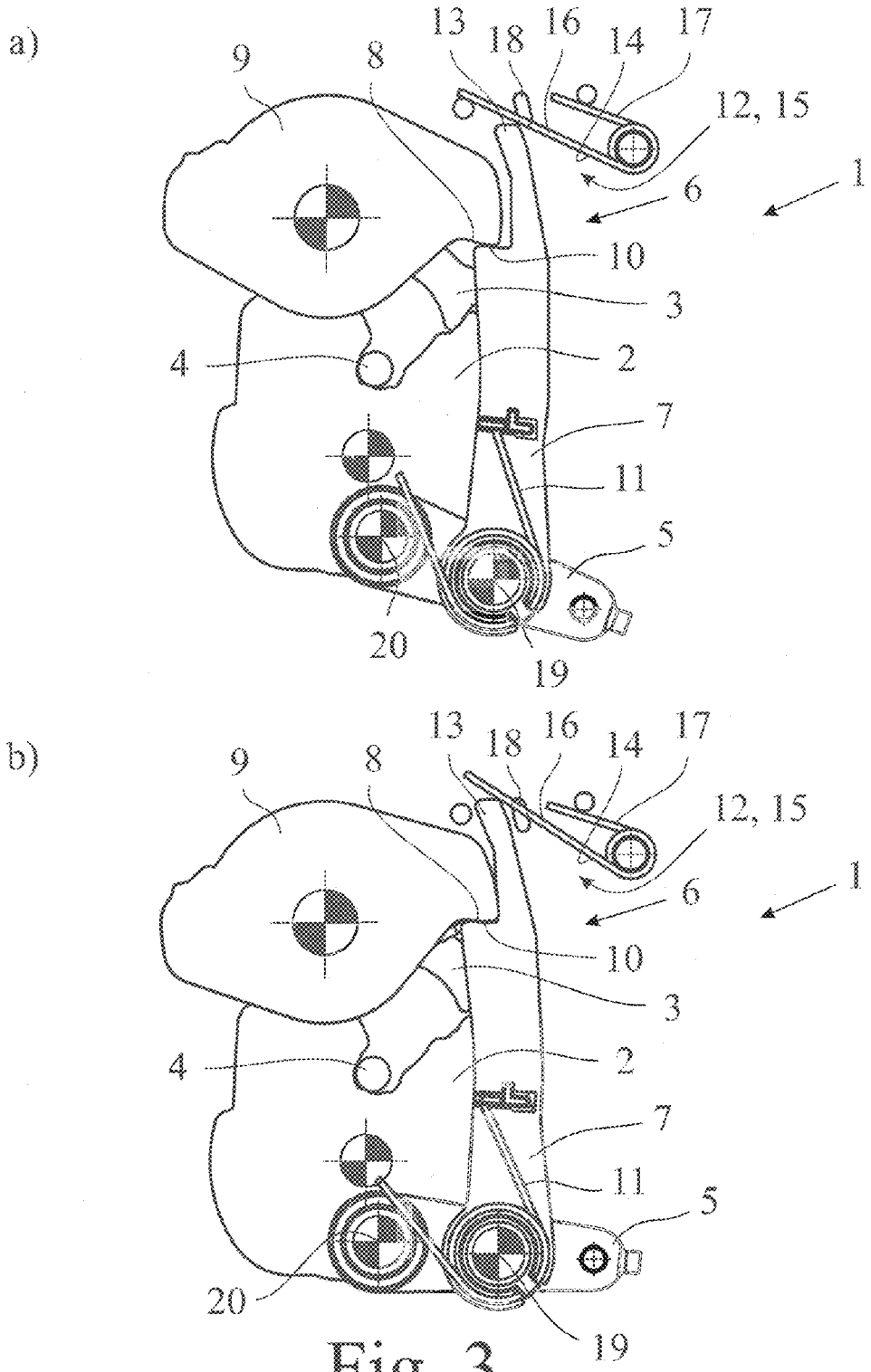

The pawl 3 may be brought into an engagement position, shown in FIG. 1, in which it is in blocking engagement with the catch 2. In the depicted embodiment, the pawl 3 blocks the catch 2 in its closed position in a mechanically stable manner such that the pawl 3 itself does not have to be blocked, which is also the preferred case. For release of the catch 2 into its open position, the pawl 3 may be deflected into a release position, which is shown in FIG. 3, and which release position would correspond to a deflection in the anti-clockwise direction starting from FIG. 1.

FIG. 1 also discloses a pawl actuation lever 5 that is provided for deflecting the pawl 3 into the release position. The pawl actuation lever 5 may be coupled to a door handle, preferably to an outer door handle, such that the assigned motor vehicle door may be opened by actuating the door handle, thereby actuating also the pawl actuation lever 5. The preferred apparatus for coupling the outer door handle to the pawl actuation lever 5 is a Bowden cable.

FIG. 1 also shows that an engagement arrangement 6 is provided between the pawl actuation lever 5 and the pawl 3, wherein the engagement arrangement 6 comprises a deflection lever 7 on the side of the pawl actuation lever 5 and a counter contour 8 on the side of the pawl 3. The deflection lever 7 is configured to engage the counter contour 8, thereby deflecting the pawl 3 into the release position. Such an engagement of the counter contour 8 by the deflection lever 7 with the resulting pawl 3 in the released position is shown in FIG. 3. It is to be noted that the deflection lever 7 does not need to be a lever in the strict sense, it may be any structure configured to engage a counter contour 8 and thereby deflect the pawl 3 into the release position.

Further an actuation movement of the pawl actuation lever 5 for deflecting the pawl 3 into the released position is translated into a deflection movement of the deflection lever 7.

In other words, actuating the pawl actuation lever 5 causes a movement of the deflection lever 7, which movement is called a deflection movement and which is, in principle, liable to move the deflection lever 7 such that it engages the counter contour 8 and thereby deflects the pawl 3 into the release position. This translation of the movement of the pawl actuation lever 5 into the deflection movement of the deflection lever 7 may occur either through a direct coupling between the pawl actuation lever 5 and the deflection lever 7 or it may involve any number of intermediate parts for translating this movement.

It can be seen from FIG. 3 that an actuation movement of the pawl actuation lever 5 corresponds to a rotation of the pawl actuation lever 5 in a counter clockwise direction and translates into a deflection movement of the deflection lever 7 in the same direction. Here and as is preferred, the deflection movement of the deflection lever 7 may be any rotational movement, translational movement or combination thereof.

The proposed motor vehicle lock 1 is now characterized in that an inertial characteristic of the deflection lever 7 causes a deflection movement along a free-wheeling path, in which free-wheeling path the deflection lever 7 misses the counter contour 8, when the actuation movement surpasses a rapidity threshold. A completed deflection movement along the free-wheeling path is shown in FIG. 4.

The proposed motor vehicle lock 1 is further characterized in that the inertial characteristic of the deflection lever 7 causes a deflection movement along an engagement path, in which engagement path the deflection lever 7 engages the counter contour 8 when the actuation movement is below the rapidity threshold. A deflection movement along the engagement path is shown in the sequence of FIGS. 3*a* and *b*.

In this context, an inertial characteristic may refer to the inertial mass of the deflection lever 7, the moment of inertia of the deflection lever 7 or to both quantities. It may also, in addition or alternatively, refer to the center of mass of the deflection lever 7. Likewise, the rapidity threshold may be defined in terms of the speed or velocity of the actuation movement, in terms of the acceleration of the actuation movement or may in fact involve both quantities. It is also to be noted that there exists, in principle, more than one free-wheeling path and more than one engagement path. To the contrary, any path of a deflection movement which results in the deflection lever 7 missing the counter contour 8 is by definition a free-wheeling path, whereas any path of a deflection movement which results in the deflection lever 7 engaging the counter contour 8 is by definition an engagement path.

Figure 4:
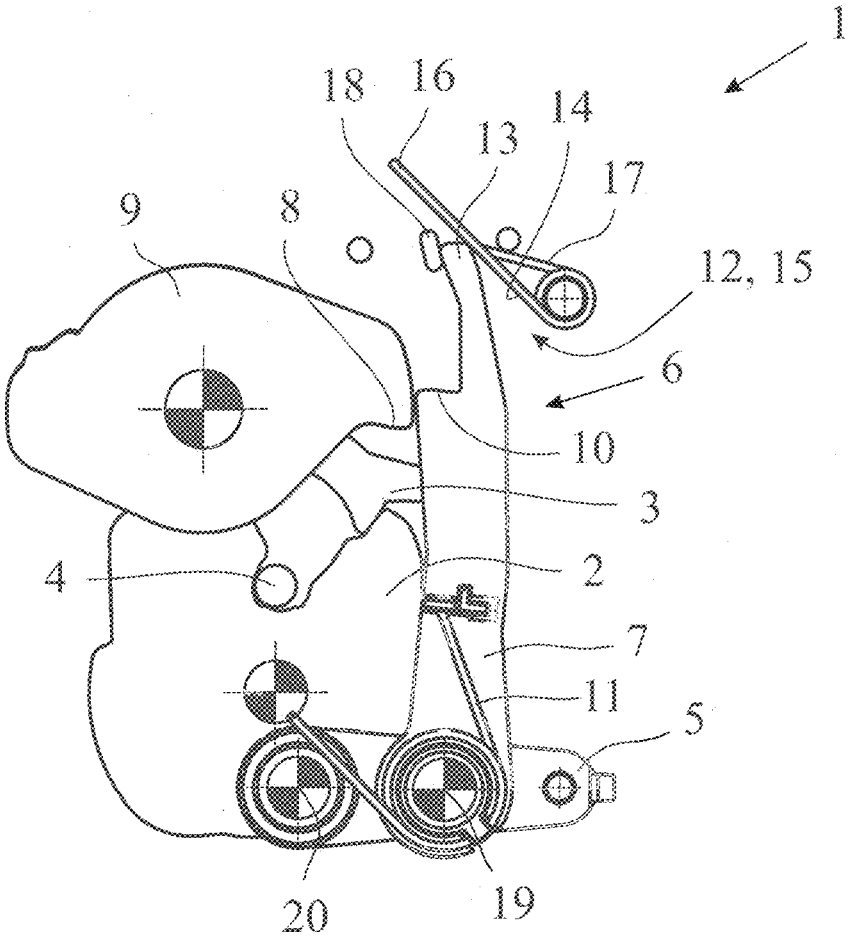

As mentioned, FIG. 4 now shows the deflection lever 7 having completed a deflection movement along a free-wheeling path. As can be seen, the deflection lever 7 has moved towards the counter contour 8 but has missed the counter contour 8 and thereby has not engaged the counter contour 8. The result is that the pawl 3 is not deflected.

As also mentioned, the sequence of FIGS. 3*a* and *b* shows the deflection lever 7 having completed a deflection movement along the engagement path with the result that the deflection lever 7 has engaged the counter contour 8, thereby deflecting the pawl 3 and having the catch 2 being released from the pawl 3. In other words, depending on how fast the actuation movement of the pawl actuation lever 5 occurs in terms of either speed, velocity and/or acceleration, the deflection lever 7 either engages a counter contour 8 or not. In particular, great speeds, velocities or accelerations of the actuation movement result in a free-wheeling path of the deflection movement and thereby prevent engagement. It is to be pointed out that because of the translation of the actuation movement of the pawl actuation lever 5 into the deflection movement of the deflection lever 7, any actuation movement with great speed, velocity or acceleration translates into a deflection movement of the deflection lever with proportional, if not identical, properties. This correspondence also holds when the actuation movement of the pawl actuation lever 5 exhibits small speed, velocity or acceleration.

As shown in the drawings and as is also preferred, the counter contour 8 is arranged on a contour plate 9 which is coupled torque-proof to the pawl 3. Alternatively or in addition, the deflection lever 7 comprises a corner profile 10 for engaging the counter contour 8.

To further adjust the characteristic behavior of the deflection lever 7 on its deflection movement, in which it may take a free-wheeling path or an engagement path, it is preferred that a free-wheeling pre-tension force towards a free-wheeling path is exerted on the deflection lever 7. By having such a free-wheeling pre-tension force acting on the deflection lever 7 to move towards the free-wheeling path, it is no longer necessary to rely solely on the inertial mass of the deflection lever 7 or on the circular motion of the deflection lever 7 to achieve this effect. Preferably, such a free-wheeling pre-tension force towards a free-wheeling path is exerted by free-wheeling spring arrangement 11, which spring biases the deflection lever 7 in a clockwise direction in FIGS. 2 to 4.

To achieve predefined behaviors at different speeds or accelerations, i.e. to engage the counter contour 8 below a certain threshold and to move along the free-wheeling path beyond the threshold, it is preferred that the inertial characteristic of the deflection lever 7 comprises the inertial mass and in addition, or alternatively, the center of mass. This inertial characteristic is configured such that is causes a deflection movement along the free-wheeling path through the centrifugal force acting on the deflection lever 7 when the actuation movement surpasses a predetermined rapidity threshold.

Since it is a solid object, the deflection lever 7 has by necessity an intrinsic inertial mass and a center of mass. Both the inertial mass and the center of mass may be set to achieve the desired behavior with regard to the deflection movement path taken.

The inertial mass and the center of gravity may, for example, be either set during production of the deflection lever 7, for example by choosing its dimensions and the material used, or it may also be adjusted by adding further components that add to its inertial mass. Thereby the desired behavior with relation to the predetermined rapidity threshold may be achieved.

Figure 2:
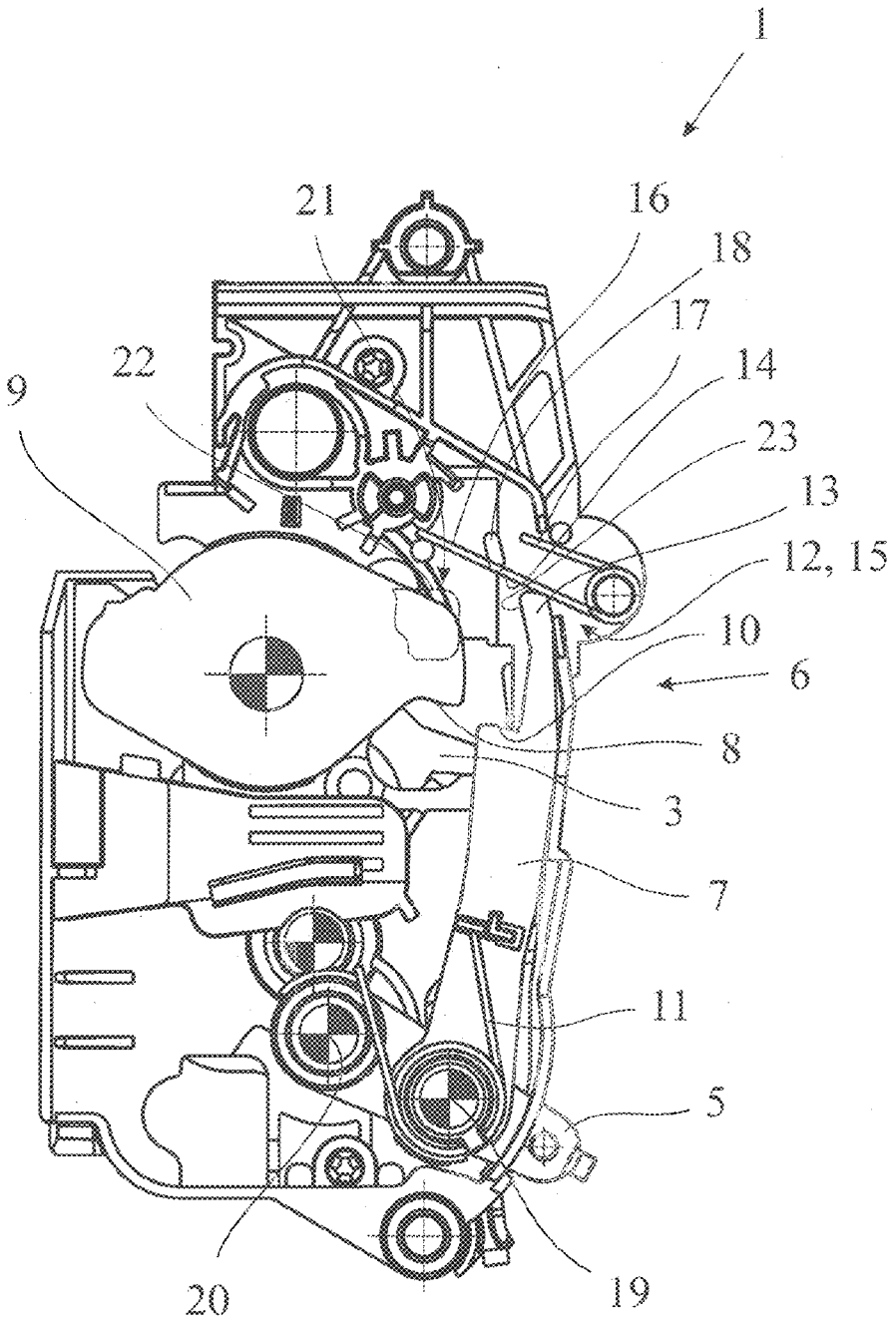

The sequence of FIGS. 2, 3*a* and 3*b* show an actuation of the pawl actuation lever 5 during normal operation. Those figures show that an at least partly resilient guiding arrangement 12 is provided for sliding engagement with the deflection lever 7. FIG. 2 and FIG. 3*a* in combination show that the guiding arrangement 12 guides the deflection lever 7 into the engagement path which leads to deflecting the pawl 3 into its release position. FIGS. 2, 3*a* and 3*b* in combination show that during normal actuation the deflection lever 7 is redirected by the guiding arrangement 12 in a counter clockwise direction in the drawings. This redirection requires to accelerate the weight of the deflection lever 7, which again requires the above noted guiding forces to be provided by the guiding arrangement 12. This is the situation when the actuation movement is staying below the rapidity threshold.

For the above noted sliding engagement with the guiding arrangement 12 the deflection lever 7 comprises an engagement surface 13, which engagement surface 13 is located in an end section of the deflection lever 7, which end section is also assigned to the engagement with the counter contour 8.

Particularly interesting is the fact that when the actuation movement surpasses the rapidity threshold as shown in FIG. 4, the inertial characteristic of the deflection lever 7 causes the deflection lever 7 to exert forces onto the resilient guiding arrangement 12 via the sliding engagement, such that the resilient guiding arrangement 12 deforms and releases the deflection lever 7 into the free-wheeling path. FIG. 4 shows that the above noted deformation is a deformation in the upward direction in FIG. 4 which allows the deflection lever 7 to offset the deflection movement to the right in FIG. 4. This effect may be achieved by a corresponding weight distribution of the deflection lever 7 as noted above.

The drawings show that the resilient guiding arrangement 12 comprises a guiding contour 14 for the sliding engagement with the deflection lever 7. This guiding contour 14 may generally be of rigid characteristic, which guiding contour 14 is being displaced during deformation of the guiding arrangement 12 due to surpassing of the rapidity threshold by the actuation movement. In the preferred embodiment shown in the drawings, however, the guiding contour 14 itself is being deformed when the rapidity threshold is being surpassed as noted above. This kind of resilience of the guiding arrangement 12 reduces the risk of unpredictable breakage of the guiding arrangement 12, because the number of rigid components is being reduced.

It may also be advantageous to allow predefined components of the motor vehicle lock 1 to break during a crash situation. The guiding arrangement 12 may be such a component. However, here and preferably, the guiding arrangement 12 is designed as an elastically resilient guiding arrangement 12 such that breakage of the guiding arrangement 12 during a crash situation is prevented.

As is shown in the drawings the guiding arrangement 12 comprises a spring arrangement 15 which compresses for deformation of the guiding arrangement 12, when the actuation movement of the deflection lever 7 surpasses the rapidity threshold as shown in FIG. 4.

The embodiment shown in the drawings comprises a spring arrangement 15 which provides the guiding arrangement 12 in a very cost efficient manner. Here, the spring arrangement 15 comprises a leg spring with two legs 16, 17. Preferably, one of the legs 16, 17 of the spring arrangement provides at least a part of the guiding contour 14 for the sliding engagement with the deflection lever 7. As shown in FIG. 4, the leg 16 provides the guiding contour 14 and deflects, when the actuation movement surpasses a rapidity threshold. As a result the guiding arrangement 12 deforms thereby releasing the deflection lever 7 into the free-wheeling path.

In the embodiment shown in the drawings a separation contour 18 is provided which is engageable with the deflection lever 7 after deformation of the guiding arrangement 12 due to surpassing of the rapidity threshold by the actuation movement. This engagement prevents the deflection lever 7 to move between the free-wheeling path and the engagement path. Also the separation contour 18 prevents the deflection lever 7 to move from the engagement path to the free-wheeling path as may be seen in FIG. 3*b*. It has proven particularly useful and is also shown in the drawings that the deflection lever 7 is configured to pivot around a deflection lever axis 19. Further preferably, the pawl actuation lever 5 is configured to pivot around an actuation lever axis 20, while the deflection lever 7 is pivotable coupled to the pawl actuation lever 5 via the deflection lever axis 19. As the deflection lever axis 19 is displaced from the actuation lever axis the rotating movement of the pawl actuation lever 5—caused by its actuation—is translated into a combined linear and circular motion of the deflection lever 7 in its deflection movement.

It is preferred that the pawl actuation lever 5 is assigned a return spring arrangement (not shown) which is configured to exert a return force on the pawl actuation lever 5. In FIGS. 2 to 4 this return force urges the pawl actuation lever 5 in the clockwise direction. Here and preferably the return spring arrangement acts on a return protrusion (not shown) of the pawl actuation lever 5, in a direction opposite too, i.e. counter acting, the deflection movement as noted above.

It may be economical to employ the engagement arrangement 6 described not only for crash safety, but also for implementing a "locked" or "unlocked" functional state during normal operation of the motor vehicle lock. Those functional states are useful during normal operation, in particular when a door handle, which is connected to the pawl actuation lever 5, shall be enabled or disabled regarding deflecting of the pawl 3.

Therefore it is preferred that a lock mechanism 21 is provided which may be brought into different functional states such as "unlocked" and "locked" and wherein the mechanism acts on the deflection lever 7 for realizing the functional states "unlocked" and "locked". It is to be understood that in the functional state "unlocked" a lock mechanism causes a deflection movement along the free wheeling path and in the functional state "locked" the lock mechanism causes a deflection movement along the engagement path. To this end it may be advantageous that a locking lever 22 of the lock mechanism 21 engages a lock contour 23 of the deflection lever 7 for causing the deflection movement along the free wheeling path. This locking lever 22 and the lock contour 23 are only indicated in FIG. 2 in dashed line. The locking lever 22 in this embodiment may be moved to the right to switch the lock mechanism 21 to the locked state, such that an actuation of the pawl actuation lever 5 runs free. It is preferred that the lock contour 23 is arranged at the same end of the deflection lever 7 as the above noted corner profile 10.

Finally it may be pointed out that the proposed solution is not only applicable to a motor vehicle lock 1 that is actuated manually by actuating a door handle. In the case that the pawl actuation lever 5 is drivable by a motor drive, a crash induced actuation of the pawl actuation lever 5 with high rapidity accordingly leads to the pawl actuation lever 5 running free as noted above.

The invention claimed is:

1. A motor vehicle lock for a motor vehicle door arrangement, the lock comprising:

a catch and a pawl assigned to the catch, wherein the catch can be brought into an opening position and into a closed position, wherein the catch, which is in the closed position, is configured to be brought into holding engagement with a lock striker, wherein the pawl may be brought into an engagement position in which it is in blocking engagement with the catch, and wherein the pawl may be deflected into a release position in which it releases the catch;

a pawl actuation lever for deflecting the pawl into the release position;

an engagement arrangement between the pawl actuation lever and the pawl, wherein the engagement arrangement comprises a deflection lever on a side of the pawl actuation lever and a counter contour on a side of the pawl, wherein the deflection lever is configured to engage the counter contour to deflect the pawl into the release position, wherein an actuation movement of the pawl actuation lever for deflecting the pawl into the release position is translated into a deflection movement of the deflection lever, wherein an inertial characteristic of the deflection lever causes the deflection movement of the deflection lever along a free-wheeling path in which the deflection lever misses the counter contour, when the actuation movement of the pawl actuation lever surpasses a rapidity threshold in a crash situation, and wherein the inertial characteristic of the deflection lever causes the deflection movement of the deflection lever along an engagement path in which the deflection lever engages the counter contour, when the actuation movement of the pawl actuation lever is below the rapidity threshold under normal conditions; and an at least partly resilient guiding arrangement configured for sliding engagement with the deflection lever and configured to guide the deflection lever into the engagement path when the actuation movement of the pawl actuation lever is below the rapidity threshold;

wherein, when the actuation movement of the pawl actuation lever surpasses the rapidity threshold, the inertial characteristic of the deflection lever causes the deflection lever to exert forces onto the resilient guiding arrangement via the sliding engagement such that a portion of the resilient guiding arrangement is displaced and releases the deflection lever into the free-wheeling path.

2. The motor vehicle lock according to claim 1, wherein the counter contour is arranged on a contour plate which is coupled torque-proof to the pawl and/or wherein the deflection lever comprises a corner profile for engaging the counter contour.

3. The motor vehicle lock according claim 1, wherein a free-wheeling pre-tension force towards the free-wheeling path is exerted on the deflection lever.

4. The motor vehicle lock according claim 3, wherein the free-wheeling pre-tension force towards the free-wheeling path is exerted by a free-wheeling spring arrangement.

5. The motor vehicle lock according to claim 1, wherein the inertial characteristic of the deflection lever comprises the inertial mass and/or the center of mass of the deflection lever, wherein the inertial characteristic is configured such that it causes the deflection movement of the deflection lever along the free-wheeling path when the actuation movement surpasses the rapidity threshold.

6. The motor vehicle lock according to claim 1, wherein the deflection lever comprises an engagement surface for the sliding engagement with the guiding arrangement.

7. The motor vehicle lock according to claim 6, wherein the engagement surface is located in an end section of the deflection lever, with the end section being to the engagement with the counter contour.

8. The motor vehicle lock according to claim 1, wherein the resilient guiding arrangement comprises a guiding contour for the sliding engagement with the deflection lever that is displaced when the actuation movement of the pawl actuation lever surpasses the rapidity threshold.

9. The motor vehicle lock according to claim 1, wherein the guiding arrangement is an at least partially elastically resilient guiding arrangement.

10. The motor vehicle lock according to claim 1, wherein the guiding arrangement comprises a spring arrangement which compresses when the actuation movement of the pawl actuation lever surpasses the rapidity threshold.

11. The motor vehicle lock according to claim 10, wherein the spring arrangement comprises a leg spring having two legs, wherein one of the legs provides at least a part of the guiding contour for the sliding engagement with the deflection lever and deflects when the actuation movement of the pawl actuation lever surpasses a rapidity threshold, thereby releasing the deflection lever into the free-wheeling path.

12. The motor vehicle lock according to claim 1, wherein a separation contour is engageable with the deflection lever after deformation of the guiding arrangement due to the surpassing of the rapidity threshold by the actuation movement of the pawl actuation lever, wherein the engagement between the separation contour and the deflection lever prevents the deflection lever from moving between the free-wheeling path and the engagement path.

13. The motor vehicle lock according to claim 1, wherein the deflection lever is configured to pivot around a deflection lever axis.

14. The motor vehicle lock according to claim 13, wherein the pawl actuation lever is configured to pivot around an actuation lever axis and the deflection lever is pivotably coupled to the pawl actuation lever via the deflection lever axis.

15. The motor vehicle lock according to claim 14, wherein the deflection lever axis is displaced from the actuation lever axis.

16. The motor vehicle lock according to claim 1, further comprising a lock mechanism configured to provide an unlocked functional state and a locked functional states, wherein the lock mechanism acts on the deflection lever for realizing the unlocked and locked functional states such that in the unlocked functional state the lock mechanism causes a deflection movement of the deflection lever along the free-wheeling path and in the locked functional state the lock mechanism causes a deflection movement of the deflection lever along the engagement path.

17. The motor vehicle lock according to claim 16, wherein a locking lever of the lock mechanism engages a lock contour of the deflection lever for causing the deflection movement of the deflection lever along the free-wheeling path, wherein the lock contour is arranged at a same end of the deflection lever as the corner profile.

* * * * *

UNITED STATES PATENT AND TRADEMARK OFFICE

CERTIFICATE OF CORRECTION

PATENT NO. : 9,366,063 B2
APPLICATION NO. : 13/929278
DATED : June 14, 2016
INVENTOR(S) : David Rosales and Michael Wittelsbuerger It is certified that error appears in the above-identified patent and that said Letters Patent is hereby corrected as shown below:

Claims

Column 11, line 54, Claim 7, "section being to" should read --section being assigned to--

Signed and Sealed this
Twenty-third Day of August, 2016

Michelle K. Lee

Michelle K. Lee
*Director of the United States Patent and Trademark Office*